US009550376B2

(12) United States Patent
Yamada et al.

(10) Patent No.: US 9,550,376 B2
(45) Date of Patent: Jan. 24, 2017

(54) PRINTING APPARATUS

(71) Applicant: SEIKO EPSON CORPORATION, Tokyo (JP)

(72) Inventors: Jun Yamada, Matsumoto (JP); Akihiro Toya, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/930,093

(22) Filed: Nov. 2, 2015

(65) Prior Publication Data

US 2016/0121624 A1 May 5, 2016

(30) Foreign Application Priority Data

Nov. 5, 2014 (JP) ..... 2014-224807

(51) Int. Cl.
*B41J 11/00* (2006.01)
*F26B 13/18* (2006.01)

(52) U.S. Cl.
CPC ..... *B41J 11/002* (2013.01); *F26B 13/18* (2013.01)

(58) Field of Classification Search
CPC ..... B41J 11/002; F26B 13/18
See application file for complete search history.

(56) References Cited

U.S. PATENT DOCUMENTS 5,713,138 A 2/1998 Rudd
2001/0006584 A1* 7/2001 Yoshida ..... G03G 15/6573 399/67
2004/0160502 A1* 8/2004 Kumamoto ..... B41J 11/006 347/19
2004/0189769 A1* 9/2004 Wilbur ..... B41J 11/002 347/102
2006/0023024 A1 2/2006 Niekawa
2009/0013553 A1 1/2009 Soltysiak et al.
2010/0180784 A1* 7/2010 Shiohara ..... B41J 11/002 101/424.1
2011/0205320 A1* 8/2011 Mitsuhashi ..... B41J 11/002 347/102
2013/0278669 A1 10/2013 Hamamoto
2015/0174924 A1 6/2015 Fuchioka et al.

FOREIGN PATENT DOCUMENTS

EP 1 447 229 8/2004
GB 705 304 3/1954
JP 10-217443 A 8/1998
(Continued)

OTHER PUBLICATIONS

European Search Report for Application No. 15192833.0 dated Apr. 4, 2016.

*Primary Examiner* — Stephen Meier
*Assistant Examiner* — Alexander D Shenderov
(74) *Attorney, Agent, or Firm* — Workman Nydegger

(57) ABSTRACT

A printing apparatus includes a dryer that heats and dries a print base material on which a print image is formed in a printing unit. The dryer includes a rotational drum that supports and transports the print base material, and a blower unit that blows hot air to the print base material supported by the rotational drum. The dryer includes a movement unit that displaces the blower unit to a first position which allows the print base material to be heated and to a second position which is away from the print base material while maintaining the blower unit in operation.

10 Claims, 7 Drawing Sheets

(56) References Cited

FOREIGN PATENT DOCUMENTS

| | | | |
|---|---|---|---|
| JP | 2001-113686 | | 4/2001 |
| JP | 2001-113686 | A | 4/2001 |
| JP | 2004-106346 | | 4/2004 |
| JP | 2009-226812 | | 10/2009 |
| JP | 2010-533076 | A | 10/2010 |
| JP | 2013-203544 | A | 10/2013 |
| JP | 2013-226659 | A | 11/2013 |

* cited by examiner

PRINTING APPARATUS

CROSS-REFERENCE TO RELATED APPLICATIONS

The present application claims priority to Japanese Patent Application No. 2014-224807 filed on Nov. 5, 2014, which is hereby incorporated by reference in its entirety.

BACKGROUND

1. Technical Field

Embodiments of the present invention relates to a printing apparatus.

2. Related Art

An ink jet printer is an example of a printing apparatus that forms a print image by ejecting ink droplets to a recording medium. Some ink jet printers have a dryer that heats and dries the ink ejected on the recording medium (for example, JP-A-2013-203544, JP-T-2010-533076).

SUMMARY

In an ink jet printer that includes a dryer, print processing may be temporarily suspended for a maintenance purpose. If the operation of the dryer is stopped when print processing is temporarily suspended, it takes time for the temperature of a heat source included in the dryer to return to an operational temperature before the print processing is resumed. Thus the efficiency of the print processing may be decreased. However, if the operation of the dryer is continued while the print processing is suspended, the recording medium may receive excessive heat from the dryer and deteriorate.

Embodiments of the invention solve the above-mentioned problem not only in an ink jet printer but also in a printing apparatus that includes a heater that is capable of heating at least a recording medium. The following aspects of embodiments of the invention may be implemented.

[1] In one embodiment, a printing apparatus is provided. The printing apparatus may include a supporter, a heater, and a state switcher. The supporter may be able to support a recording medium on which a print image is formed. The heater may be able to heat the recording medium supported by the supporter. The state switcher may switch the heater between a first state in which heating of the recording medium is allowed and a second state in which heating of the recording medium is blocked in a state where the heater is in operation. In one example of the printing apparatus, heating of the recording medium by the heater is suspended by switching the heater from the first state to the second state, thereby suppressing reduction of the operational temperature of the heater during the suspension. Therefore, after the start of heat treatment, the operational temperature of the heater can be quickly reached when the heater is switched back to the first state, and thus the efficiency of the print processing is increased. Also, in the second state, the heater is suppressed or blocked from heating the recording medium (the recording medium does not receive excessive heat) and thus deterioration of the recording medium is reduced.

[2] In one embodiment, the state switcher may include a movement unit that moves the heater to a first position when the heater is in the first state or that moves the heater to a second position when the heater is in the second state. The second position of the heater may be more distant from the recording medium than the first position of the heater. In one example, switching the heater from the first state to the second state is made by movement of the heater.

[3] In one embodiment, the heater may include a blower that delivers hot air, and the state switcher may include a hot air receiver that receives the hot air from the blower when the heater is located at the second position. In this example of the printing apparatus when the heater is located at the second position, hot air from the heater can be received by the hot air receiver. Thus the occurrence of a failure such as the deterioration of an unexpected portion in the printing apparatus due to the heat of hot air delivered by the blower is suppressed or prevented.

[4] In one embodiment of the printing apparatus, the heater may further include a collector that collects at least part of the hot air that is delivered from the blower. In this example, the occurrence of a failure due to the heat of hot air delivered by the blower is suppressed. Also, the hot air collected by the collector is circulated and can be reused for heating the recording medium.

[5] In one embodiment, the hot air receiver may have a surface corresponding to a surface of the supporter that receives the hot air from the blower when the heater in located at the first position. In this example, when the heater is at the second position, hot air is collectable by the collector in the same manner as at the first position, and thus reduction in the collection efficiency of the hot air due to the displacement of the heater is suppressed.

[6] In one embodiment, the heater may include a blower that delivers hot air through an air blowing opening to heat the recording medium, and the state switcher may include an opening and closing portion that opens the air blowing opening in the first state and that closes the air blowing opening in the second state. In this example, switching the heater from the first state to the second state is easily made by opening and closing the air blowing opening.

[7] The printing apparatus may further include a controller that controls the state switcher. The supporter may be configured to transport the recording medium so that the recording medium passes through a heating region heated by the heater when the heater is in the first state. When transport of the recording medium by the supporter is stopped, the controller may switch the heater from the first state to the second state by controlling the state switcher. In this example, when transport of the recording medium is stopped, heating of the recording medium by the heater is suppressed, and thus deterioration of the recording medium is reduced.

[8] The printing apparatus may further include a recording unit that forms the print image on the recording medium upstream of the supporter and transports the recording medium to the supporter. The controller may control the transport of the recording medium by the supporter. When the transport of the recording medium by the supporter is stopped, the controller may stop transport by the supporter after the print image formed on the recording medium by the recording unit passes through the heating region, and the controller may switch the heater from the first state to the second state by controlling the state switcher. In this example, stopping the transport of the recording medium when the print image formed in the recording unit is undried is suppressed, and thus the print image is protected.

All of a plurality of components included in each of the above-described embodiments of the invention are not required. In order to solve part or all of the above-mentioned problems or to achieve part or all of the above-mentioned effects described in the present description, part or some of the components may be modified, deleted, or replaced with other new components, or limited content may be partially deleted as needed. Also, in order to solve part or all of the above-mentioned problems or to achieve part or all of the above-mentioned effects described in the present description, part of all of the technical features included in one aspect or embodiment of the invention described above may be combined with part of all of the technical features included in another aspect or embodiment of the invention described above to form an independent aspect or embodiment of the invention.

Embodiments of invention may also be implemented in various aspects other than print or a printing apparatus. For instance, embodiments of the invention may be implemented as a heating device or a drying device, a control method of those devices, a heating method, drying method of the base material, a computer program that achieves those methods, or a non-transitory recording medium on which the computer program is recorded.

BRIEF DESCRIPTION OF THE DRAWINGS

Embodiments of the invention will be described with reference to the accompanying drawings, wherein like numbers reference like elements.

DESCRIPTION OF EXEMPLARY EMBODIMENTS

A. First Embodiment

Figure 1:
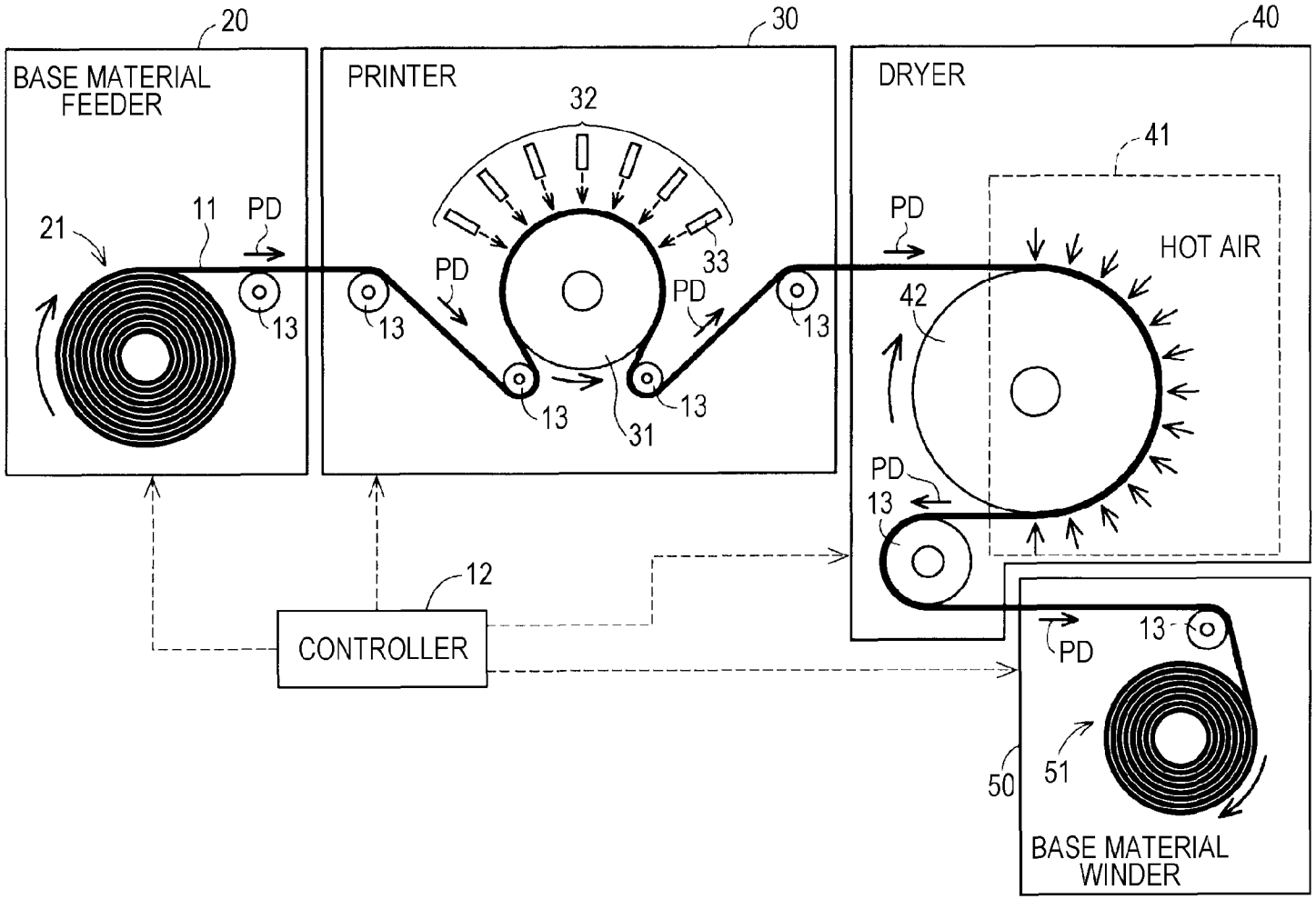
FIG. 1 is schematic diagram illustrating the configuration of a printing apparatus according to one embodiment.

Entire Configuration of Printing Apparatus FIG. 1 is a schematic diagram illustrating an example configuration of a printing apparatus 10 according to one of the invention. The printing apparatus 10 in the present embodiment may be an ink jet line printer that ejects ink droplets to form an image. The printing apparatus 10 may perform continuous printing while transporting a print base material 11, which is a strip-shaped recording medium in one example, in the longitudinal direction. The print base material 11 may include, for instance, gloss paper, coated paper and label paper, and an OHP film. In addition, regular paper, Japanese paper, ink jet paper, or textile may be used as the print base material 11.

The printing apparatus 10 includes a controller 12, a plurality of transport rollers 13, a base material feeder 20, a printer 30, a dryer 40, and a base material winder 50. The controller 12 is constituted by a microcomputer including a central processing unit and a main memory unit, and is capable of controlling each component of the printing apparatus 10. Specifically, the controller 12 can control the transport of the print base material 11 in the printing apparatus 10, forming of a print image by the printer 30, and the operation of the dryer 40. In particular, in one embodiment, the controller 12 can control switching of the operational state of a blower unit 41 in the dryer 40 when print processing is temporarily suspended (details will be described below). The controller 12 can switch the operational state of the blower unit 41 between a first state or position and a second state or position in one example.

The transport rollers 13 form a transport path for the print base material 11 in the printing apparatus 10. Each of the transport rollers 13 is disposed as needed in the base material feeder 20, the printer 30, the dryer 40, and the base material winder 50. FIG. 1 illustrates arrows PD that indicate the transport direction of the print base material 11 when a print image is formed. In the present description, the term "upstream" or "downstream" is used with respect to the transport direction of the print base material 11 when a print image is formed.

The base material feeder 20 includes a base material roller 21 around which the print base material 11 is wound in a roll shape. The base material roller 21 is rotated by a motor controlled by the controller 12 at a predetermined rotational speed such that the print base material 11 is fed to the printer 30 located downstream of the base material feeder 20.

The printer 30 includes a rotational drum 31 and a print head 32. The printer 30 forms a print image on the printing surface of the print base material 11. The printer 30 corresponds to the recording unit. The rotational drum 31 is rotated by a motor controlled by the controller 12 at a predetermined rotational speed and transports the print base material 11 while supporting the print base material 11 on the circumferential lateral surface of the rotational drum 31.

The print head 32 includes a plurality of print heads 33 that eject inks of different colors. Each of the print heads 33 may be a line head in which nozzles that can eject ink droplets are disposed in a width direction of the print base material 11. The print heads 33 are arranged in a transport direction of the print base material 11 along the circumferential lateral surface of the rotational drum 31. The print heads 33 form a print image by ejecting ink droplets to the printing surface of the print base material 11 which is transported by the rotational drum 31, at the timing and in a size according to a command of the controller 12.

A dryer part or dryer 40 is located downstream from the printing unit 30. The dryer 40 includes a blower unit 41 and a rotational drum 42. The dryer 40 heats the printing surface of the print base material 11 with hot air delivered from the blower unit 41 to dry the ink ejected on the printing surface of the print base material 11, which is being transported by the rotational drum 42 and supported by the rotational drum 42. Also, the dryer 40 collects the delivered hot air and reuses the hot air to dry the print base material 11. In addition, the dryer 40 has a mechanism capable of switching the operational state of the blower unit 41. For example, when print processing of the printing apparatus 10 is temporarily suspended, the operational state of the blower unit 41 may be switched. The details of the configuration of the dryer 40 will be described later.

The base material winder 50 is located downstream of the dryer 40. The base material wider 50 includes a winding roller 51 that is driven to rotate at a predetermined rotational speed according to a command of the controller 12. The winding roller 51 winds the print base material 11 which is fed from the dryer 40. In accordance with the configuration above, the printing apparatus 10 continuously performs printing on the print base material 11.

Configuration of Dryer (1) Summary

Hereinafter, first, in order to describe the drying mechanism of the dryer 40 for the print base material 11, the configuration of the rotational drum 42 and the blower unit 41 in the dryer 40 will be described with reference to FIGS. 2 and. 3. Subsequently, the switching mechanism of the operational state of the blower unit 41 in the dryer 40, and the switching control of the operational state performed by the controller 12 will be described with reference to FIGS. 4, 5A and 5B in addition to FIGS. 2 and 3 as needed.

(2) Mechanism for Drying Print Base Material by Dryer (2.1) Description of a Reference View The configuration of the dryer 40 will be described with reference to FIGS. 2 and 3. FIG. 2 is a schematic side view of the dryer 40 as seen in the opposite direction to an arrow X. FIG. 3 is a schematic front view of the dryer 40 as seen in the direction of arrow Y (as seen from the rear side of the dryer 40). FIG. 2 illustrates a schematic cross-sectional configuration of the blower unit 41, taken along line II-II in FIG. 3. Similarly, FIG. 3 illustrates a schematic cross-sectional configuration of the blower unit 41, taken along line III-III in FIG. 2. FIGS. 2 and 3 illustrate arrows AFa, AFb, RFa, RFb, RFc that indicate flows of air in the blower unit 41. In FIG. 2, illustration of a drum driver 43 is omitted for convenience.

Figure 2:
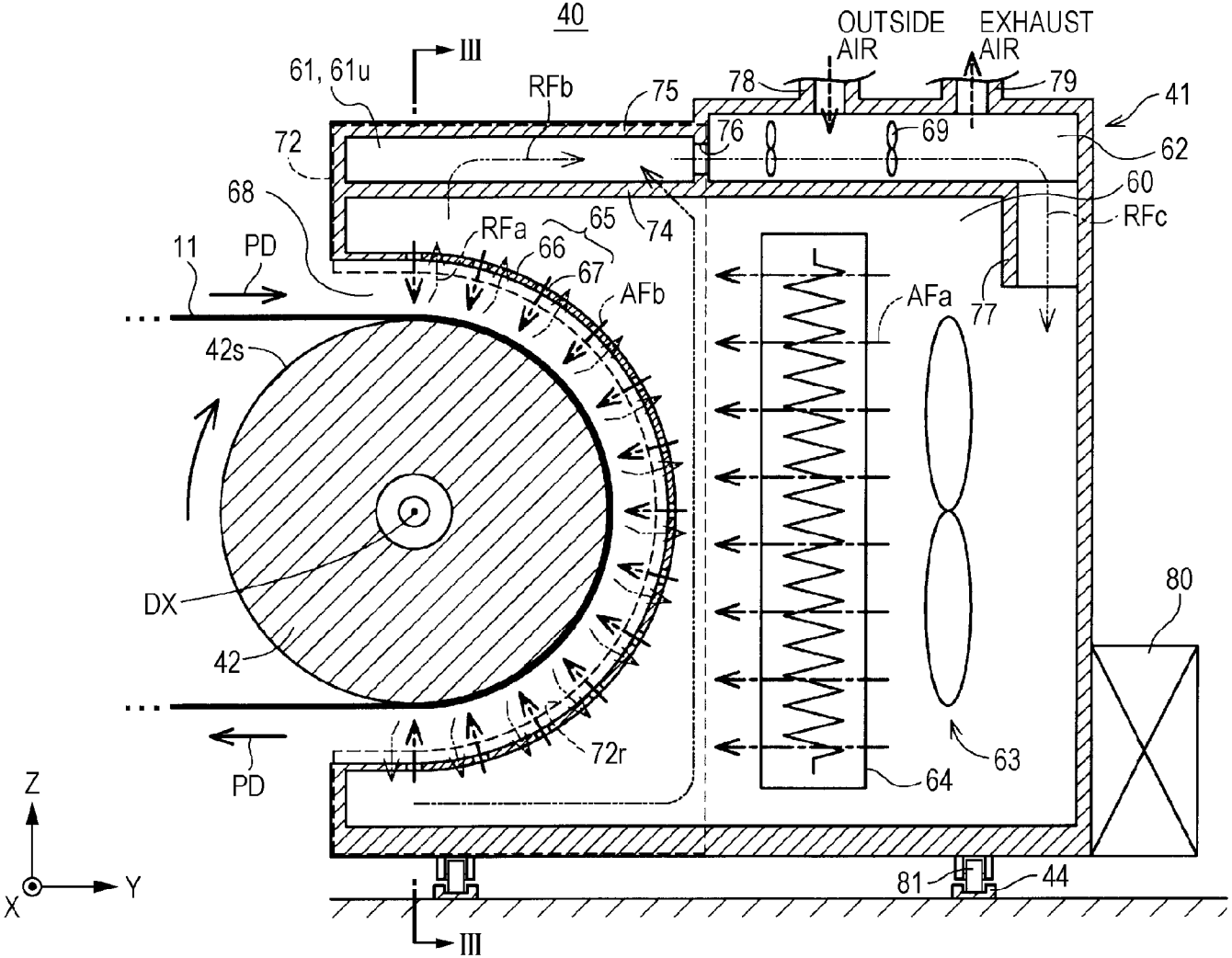
FIG. 2 is a schematic side view illustrating an example configuration of a dryer.
Figure 3:
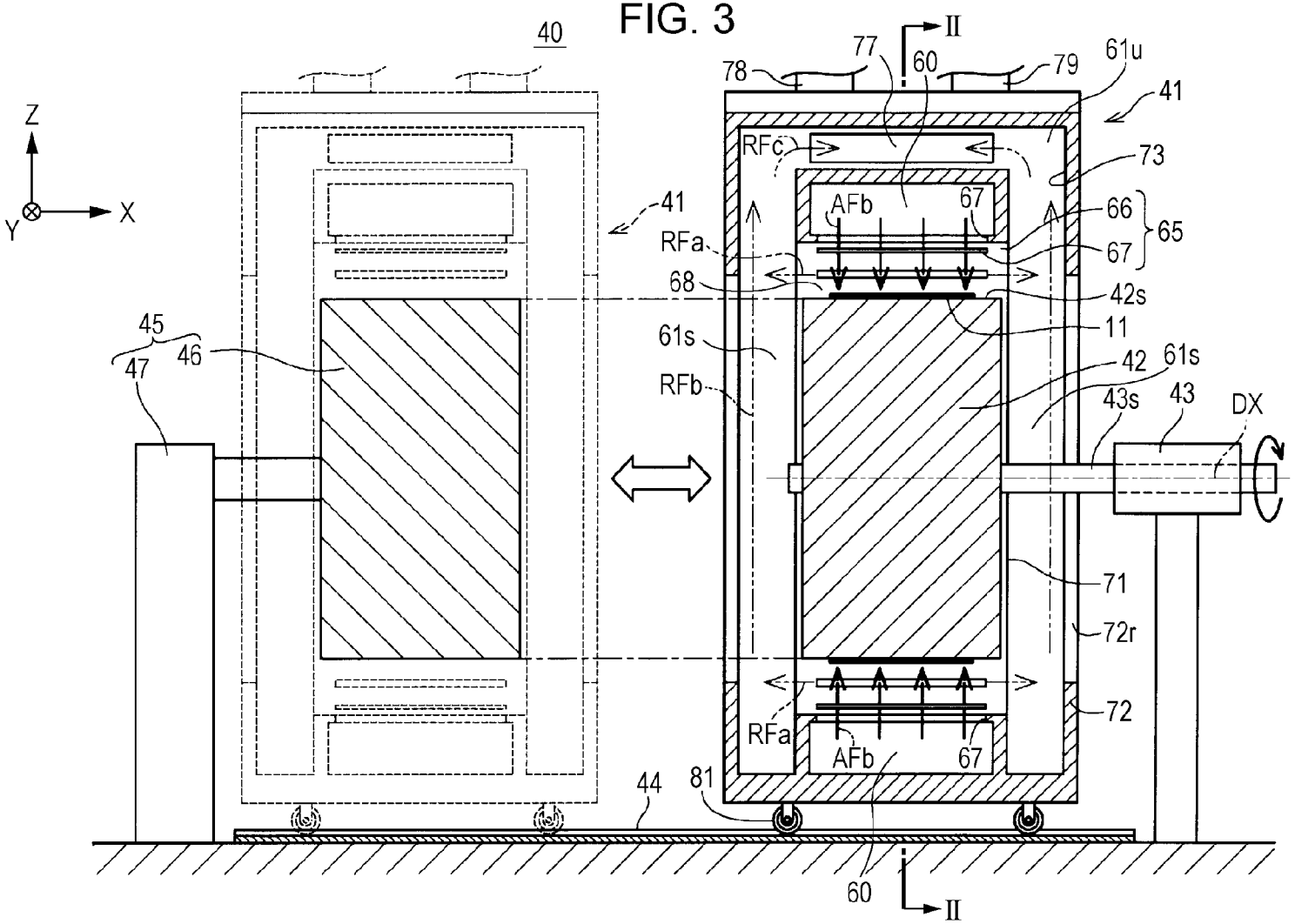
FIG. 3 is a schematic front view illustrating an example configuration of the dryer.

FIGS. 2 and 3 illustrate arrows X, Y, Z that indicate three directions perpendicular to each other. The arrow X indicates a direction parallel to the crosswise direction (width direction) of the blower unit 41 of the dryer 40, and specifically indicates the direction from the left side toward the right side when seen from the front side of the blower unit 41. The arrow Y indicates a direction parallel to the front-to-rear direction (depth direction) of the blower unit 41, and specifically indicates the direction from the rear side toward the front side of the blower unit 41. The front side of the blower unit 41 is the side (the side opposed to the rotational drum 42) where the blower unit 41 blows out hot air, and is the opposite side to the rear side of the blower unit 41. The arrow Z indicates a direction parallel to the height direction of the blower unit 41, and specifically indicates the direction opposite to the gravitational direction. The arrows X, Y, Z are also similarly illustrated in the figures referenced in the following description.

(2.2) Rotational Drum

The rotational drum 42 corresponds to the supporter in embodiments of the invention. The rotational drum 42 is supported by a rotation shaft 43*s* of the drum driver 43 so that a rotation axis DX is parallel to the direction of the arrow X (FIG. 3). The drum driver 43 includes a motor (not illustrated) and rotates the rotational drum 42 by the driving force of the motor at a rotational speed according to a command from the controller 12.

In one embodiment, the print base material 11 is wound around and transported by the rotational drum 42 in a state where the back surface of the printing surface, on which a print image is formed, is in surface contact with approximately half the circumferential lateral surface 42*s* (FIG. 2) in one example. The print base material 11 is fed in the direction of the arrow Y with respect to the rotational drum 42, the transport direction is reversed by the rotational drum 42, and the print base material 11 is fed out in the opposite direction to the arrow Y.

(2.3) Blower Unit

The blower unit 41 corresponds to the heater in embodiments of the invention. The blower unit 41 is disposed to face the rotational drum 42 so as to be able to blow hot air to the printing surface of the print base material 11 wound around the rotational drum 42, when print processing is performed in the printing apparatus 10 (FIG. 2). More specifically, the blower unit 41 is disposed so that part of the rotational drum 42 around which the print base material 11 is wound is housed in a drum disposition region 68 (described later) which is recess space provided on the front side and to which hot air is delivered.

The blower unit 41 is internally divided into a plurality of spaces by partitions. The blower unit 41 is internally provided with a heating blower chamber 60, an exhaust collection chamber 61, and a circulation air regulation chamber 62. The heating blower chamber 60 includes a blower fan 63, a heat source 64, and nozzles 65. The blower fan 63 is disposed on the side (the rearside) of the heating blower chamber 60 in the direction of the arrow Y, and generates an air current (arrow AFa) in the opposite direction to the arrow Y (in the forward direction). The blower fan 63 includes, for instance, a blower fan. The heat source 64 is disposed in front of the blower fan 63. The heat source 64 is formed to allow an air current to pass through the heat source 64. The heat source 64 heats an air current generated by the blower fan 63. The heat source 64 heats the air current, for example, when the air current passes through the heat source 64. The heat source 64 is formed of, for instance, an electrically heating wire arranged in a mesh or a fence.

The nozzles 65 correspond to the blower and are provided in front of the heat source 64. An air current heated by the heat source 64 is delivered as hot air to the outside of the blower unit 41 through the nozzles 65. The heated air current exits the blower unit 41 through the nozzles 65. The nozzles 65 have a configuration in which a plurality of slits 67 are arranged as air blowing openings for hot air in a front partition 66. The front partition 66 is a partition on the front side of the heating blower chamber 60. The front partition 66 is depressed rearward so as to form the drum disposition region 68 which is a recess space capable of housing part of the rotational drum 42 around which the print base material 11 is wound. In one embodiment, the front partition 66 is curved in an approximately semicircular shape along the circumferential lateral surface 42*s* of the rotational drum 42. The front partition 66 may have a configuration in which the front partition 66 is bent so that a plurality of planar segments is arranged along the circumferential lateral surface 42*s* of the rotational drum 42.

The slits 67 are arranged at predetermined intervals in the transport direction of the print base material 11 and are arranged to face the center (the rotation shaft 43*s* of the drum driver 43) of the drum disposition region 68 (FIG. 2). Each of the slits 67 in the front partition 66 extends in the direction of the arrow X (FIG. 3) so as to be able to blow hot air over the entire width of the print base material 11. When print processing is performed in the printing apparatus 10, hot air is uniformly blown through the slits 67 (in a direction of the arrows AFb) to the entire printing surface of the print base material 11 which is transported by the rotational drum 42 in the drum disposition region 68. Therefore, the efficiency of heating the print base material 11 by hot air is increased. Also, in one embodiment, hot air is delivered into the space (e.g., the recess space) surrounded by the front partition 66, and thus heat escape to the outside of the drum disposition region 68 as a heating region is suppressed. Therefore, the efficiency of heating the print base material 11 is further increased.

The exhaust collection chamber 61 is provided on the front side of the blower unit 41 (FIG. 2). When the blower unit 41 is viewed in the direction of the arrow Y, the exhaust collection chamber 61 has two side spaces 61*s* located on both sides of the heating blower chamber 60 in the direction of the arrow X and an upper space 61*u* located above the heating blower chamber 60 (FIG. 3). The two lateral spaces

61*s* are each a space between a side wall 71 of the heating blower chamber 60 and an outer side wall 72 of the blower unit 41. The upper space 61*u* is the space between an upper wall 74 of the heating blower chamber 60 and an upper outer wall 75 of the blower unit 41. The upper space 61*u* is connected, at both ends in the direction of the arrow X, to the two side spaces 61*s*.

Each of the side spaces 61*s* has an opening 73 that is opened toward the drum disposition space 68. The opening 73 has a shape that extends in the transport direction of the print base material 11 in the rotational drum 42. The outer side wall 72 of the blower unit 41, including the open end of the opening 73 has, on the end surface on the front side, a depressed portion 72*r* (illustrated by a dashed line in FIG. 2) that is depressed in the direction of the arrow Y to be aligned with the drum disposition space 68. The exhaust collection chamber 61 functions as a collector that collects the hot air delivered into the drum disposition space 68 through the nozzles 65, and the openings 73 of the exhaust collection chamber 61 function as an intake port.

The circulation air regulation chamber 62 is located in a rear of the exhaust collection chamber 61 and above the heating blower chamber 60. The circulation air regulation chamber 62 communicates with the exhaust collection chamber 61 through a communication hole 76 and communicates with the heating blower chamber 60 through a duct 77. The duct 77 is open in a rear of or behind the blower fan 63 in the heating blower chamber 60. In this manner, in one embodiment of the blower unit 41, the heating blower chamber 60, the exhaust collection chamber 61, and the circulation air regulation chamber 62 communicate with one another, thereby forming an air circulation path as follows.

The hot air delivered from the heating blower chamber 60 to the drum disposition space 68 is sucked into (as illustrated by the arrow RFa) the side spaces 61*s* of the exhaust collection chamber 61 through the openings 73 of the exhaust collection chamber 61 by a negative pressure caused by the blower fan 63 in the heating blower chamber 60. The hot air then flows into (as illustrated by the arrow RFb) the upper space 61*u* of the exhaust collection chamber 61, flows through the circulation air regulation chamber 62, and returns to (as illustrated by the arrow RFc) the heating blower chamber 60. In one embodiment of the blower unit 41, the load of the heat source 64 is reduced due to the circulation of heated air, and thus the heating efficiency is increased.

The circulation air regulation chamber 62 has a function of regulating the humidity and temperature of circulating air. The circulation air regulation chamber 62 is connected to an outside air introduction duct 78 and an exhaust duct 79. The circulating air can be mixed with the outside air introduced through the outside air introduction duct 78 in the circulation air regulation chamber 62. The circulating air can be partially exhausted to the outside through the exhaust duct 79. In this manner, the humidity and temperature of the circulating air can be reduced. The humidity and temperature of the circulating air are regulated, in one example, by the rotational frequency of pumps (not illustrated) provided in the outside air introduction duct 78 and in the exhaust duct 79. A decrease in the humidity of the circulating air reduces the decrease in the efficiency of drying the print base material 11 due to an increase in the humidity of circulating air. In other words, when the humidity of the circulating air decreases the efficiency of drying the print material 11, the humidity can be controlled (e.g., reduced) by controlling the air introduced through the air introduction duct 78 and the air exhausted to the outside through the exhaust duct 79. A decrease in the temperature of the circulating air prevents the temperature of circulating air from exceeding a heat resistant temperature of the blower fan 63, and thus deterioration of the blower fan 63 is reduced. The temperature of the circulating air can be controlled by controlling the air introduced through the air introduction duct 78 and the air exhausted to the outside through the exhaust duct 79.

Here, as described above, in the blower unit 41 in one embodiment, the slits 67 for delivering hot air are arranged in the transport direction of the print base material 11 so as to surround the drum disposition space 68. The openings 73 of the exhaust collection chamber 61 for introducing hot air into the exhaust collection chamber 61 are disposed outwardly of the slits 67. In this manner, hot air dissipating from the drum disposition region 68 as the heating region to the outside can be efficiently collected. Also, the entire region facing the circumferential lateral surface 42*s* of the rotational drum 42 is usable as a formation region for the slits 67, and thus the efficiency of heating the print base material 11 by hot air can be increased. In addition, since the openings 73 are disposed outwardly of the heating region, the hot air present in the heating region is prohibited from being sucked. In this manner, because the slits 67 and the openings 73 are formed in separate regions, interference between the function of the slits 67 to blow hot air and the function of the openings 73 to collect hot air is avoided. Therefore, improvement in the efficiency of heating the print base material 11 and improvement in the efficiency of collecting the hot air are both achieved.

In addition, in the blower unit 41 in one embodiment, the heating blower chamber 60 functioning as a hot air flow path for generating and delivering hot air, and the exhaust collection chamber 61 and the circulation air regulation chamber 62 functioning as an intake flow path which is a flow path for the hot air sucked through the openings 73 are disposed adjacent to each other. In this manner, the flow paths for hot gas are compactly formed and thus the efficiency of raising the temperature is increased. Also, in the blower unit 41, an intake flow rate $Q_A$ which is the flow rate of the air that flows into the openings 73 is adjusted to be larger, ion one embodiment, than air flow rate $Q_B$, which is the total of the flow rates of the hot air that is delivered out through the slits 67. Specifically, the sectional area of the air flow path from the exhaust collection chamber 61 to the intake port is designed to be larger than the opening area (opening area of the duct 77) of the intake port of the blower fan 63. Also, the circulation air regulation chamber 62 is provided with an auxiliary fan 69, thereby increasing the air circulation efficiency in the blower unit 41.

As described above, in the dryer 40 in one embodiment, the print base material 11, which is supported and transported by the rotational drum 42, is dried by blowing hot air from the blower unit 41. In the blower unit 41, the efficiency of heating the print base material 11 by hot air and the efficiency of collecting the hot air are increased.

(3) Mechanism for Switching Operational State of Blower Unit and Switching Control by Controller In the printing apparatus 10, print processing may be suspended and transport of the print base material 11 may be temporarily stopped for a maintenance purpose, for instance. In the printing apparatus 10, the operational state of the blower unit 41 is switched without stopping the operation of the blower unit 41 under the control of the controller 12 so that the dryer 40 can efficiently recover when print processing is resumed. Hereinafter, the mechanism for switching the operational state of the blower unit 41 in the dryer 40 and the switching control performed by the controller 12 will be described.

In the dryer 40, the blower unit 41 is configured to be displaceable (FIG. 2, FIG. 3). The blower unit 41 has a pulley 81 at the bottom and the pulley 81 is fitted in a rail 44 that is disposed to extend in the direction parallel to the arrow X. The blower unit 41 linearly moves back and forth on the rail 44 by a driving force transmitted via an endless belt from a driving force source 80 such as a motor under the control of the controller 12. The blower unit 41 is movable in the section between a first position at which the rotational drum 42 is housed in the center of the drum disposition region 68 and a second position at which the rotational drum 42 is away from or separated from the drum disposition region 68. FIG. 3 illustrates the blower unit 41 located at the second position with a dashed line.

A blower receiver 45 is provided at the second position of the dryer 40. The blower receiver 45 corresponds to the hot air receiver and includes a drum-shaped member 46 and a support strut 47. The drum-shaped member 46 is a cylindrical member having substantially the same shape as the rotational drum 42. The drum-shaped member 46 is composed of a highly heat-resistant resin or metal. The drum-shaped member 46 is supported by the support strut 47 at substantially the same height and substantially the same disposition angle as the rotational drum 42. When the blower unit 41 moves to the second position, the drum-shaped member 46 is housed in the drum disposition region 68 of the blower unit 41 at the same position as the rotational drum 42 when the blower unit 41 is located at the first position. The function of the air receiver 45 will be described later.

Figure 4:
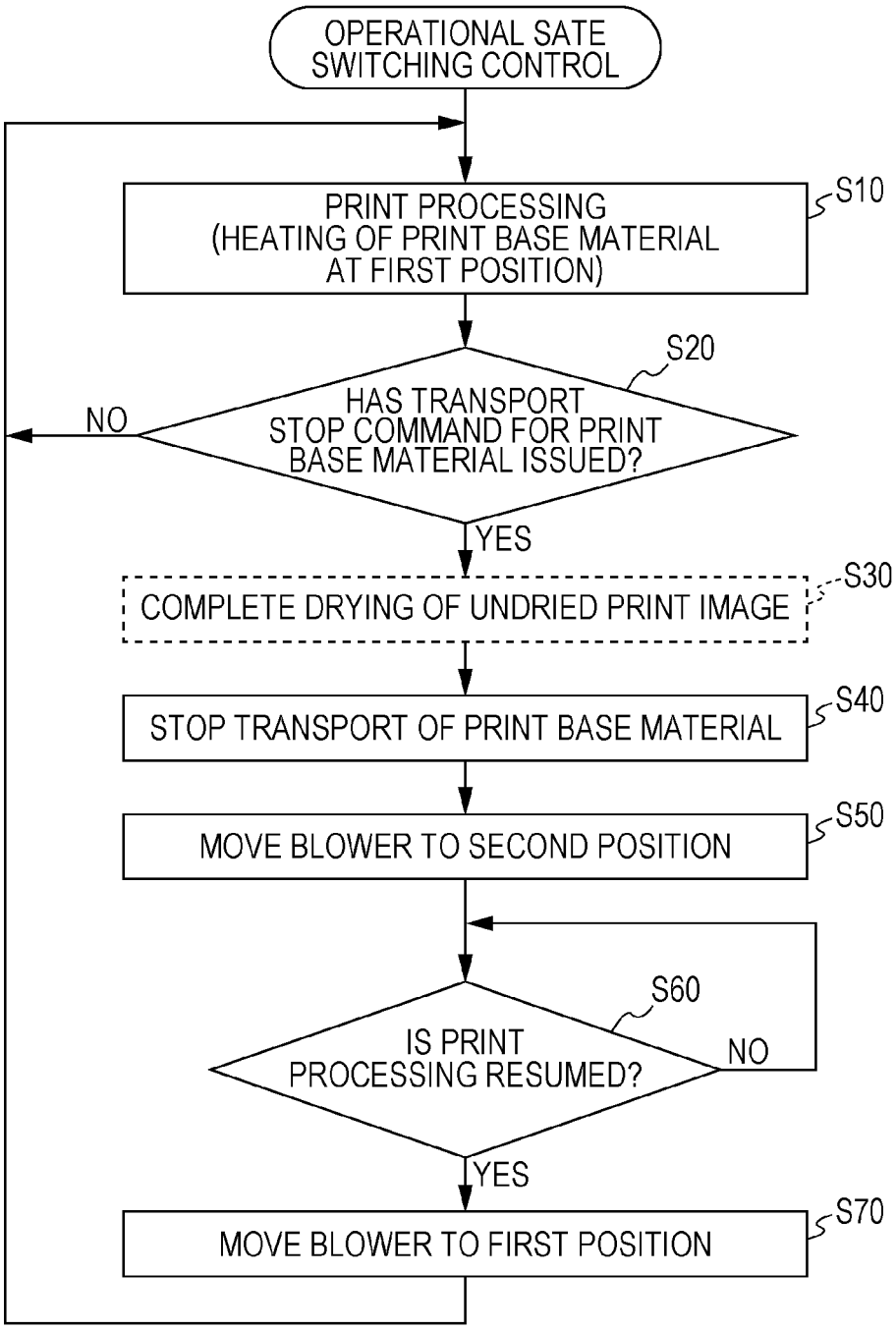
FIG. 4 is an explanatory diagram illustrating the flow of switching control of an operational state by a controller.

FIG. 4 is an explanatory diagram illustrating the flow of switching control of an operational state by the controller 12. During execution of print processing, the controller 12 moves the blower unit 41 to the first position to cause the blower unit 41 to heat the print base material 11 transported by the rotational drum 42 (step S10). During the execution of the print processing, the controller 12 may receive an external command or an internal command to suspend the print processing and stop transport of the print base material 11 because of a command by a user or an occurrence of an error (step S20). The controller 12, when receiving such a command, moves the blower unit 41 to the second position to keep the blower unit 41 away from the rotational drum 42 without stopping the operation of the blower unit 41 by the following processing (steps S30 to S50). In the present description, "stop of the operation of the blower unit 41" indicates a state where at least the temperature raising function of the heat source 64 is stopped.

In step S30, the controller 12 detects an undried print image and continues to transport the print base material 11 and to heat the print base material 11 by the blower unit 41 until the undried print image passes through the dryer 40. The controller 12 stores a time when the print image is formed in the printer 30 and detects the presence of an undried print image before passing the dryer 40, which is formed in the printing unit 30 before the print processing is suspended, based on the time and the transport speed of the print base material 11. The controller 12 then calculates the time when the undried print image passes through the dryer 40 based on the transport speed of the print base material 11, and continues to heat the print base material 11 by the blower unit 41 until the calculated time. In other words, the controller 12 may ensure that any undried image is dried in the dryer 40 before stopping the transport of the print base material 11 in one example.

The controller 12 assumes that the undried print image passes through the dryer 40 when the current time passes the calculated time. The controller 12 then stops the transport of the print base material 11 (step S40). The controller 12 then moves the blower unit 41 to the second position (step S50). In this manner, the print image formed in the printing unit 30 due to the suspension of the print processing is avoided. Thus, the print image is not wasted due to the suspension of the print processing in one example.

The controller 12 continues the operation of the blower unit 41 when the blower unit 41 is at or moved to the second position (step S60) until the print processing is resumed by a command or the like from a user or from another source. When the print processing is resumed, the controller 12 returns the blower unit 41 to the first position, and allows heating of the print base material 11 to be resumed (step S70). In this manner, when the print processing is suspended, the blower unit 41 is retreated or moved away from the base print medium without stopping the operation of the blower unit 41. Thus, when the print processing is resumed, the time taken to raise the temperature of the blower unit 41 to an operational temperature can be shortened. Therefore, the efficiency of resuming operation of the dryer 40 is increased. Also, deterioration of the print base material 11, which is caused by continuous exposure of the print base material 11 to hot air from the blower unit 41 with the transport stopped, is reduced.

The operational state of the blower unit 41 located at the first position is interpretable as the first state in which heating to the print base material 11 is allowed. In other words, hot air is delivered to the print base material 11 by the blower unit 41 in the first state or in the first position. Also, the operational state of the blower unit 41 when located at the second position is interpretable as the second state in which heating to the print base material 11 is blocked. In other words, when the blower is located at the second position or in the second state, hot air delivered by the blower unit 41 through the nozzles 65 is not delivered to the print base material 11. In one embodiment, the rail 44 and the movement unit such as the driving force source 80 and the pulley 81 for moving the blower unit 41 correspond to an example of the state switcher that switches the operational state of the blower unit 41 between the first state and the second state.

Figure 5B:
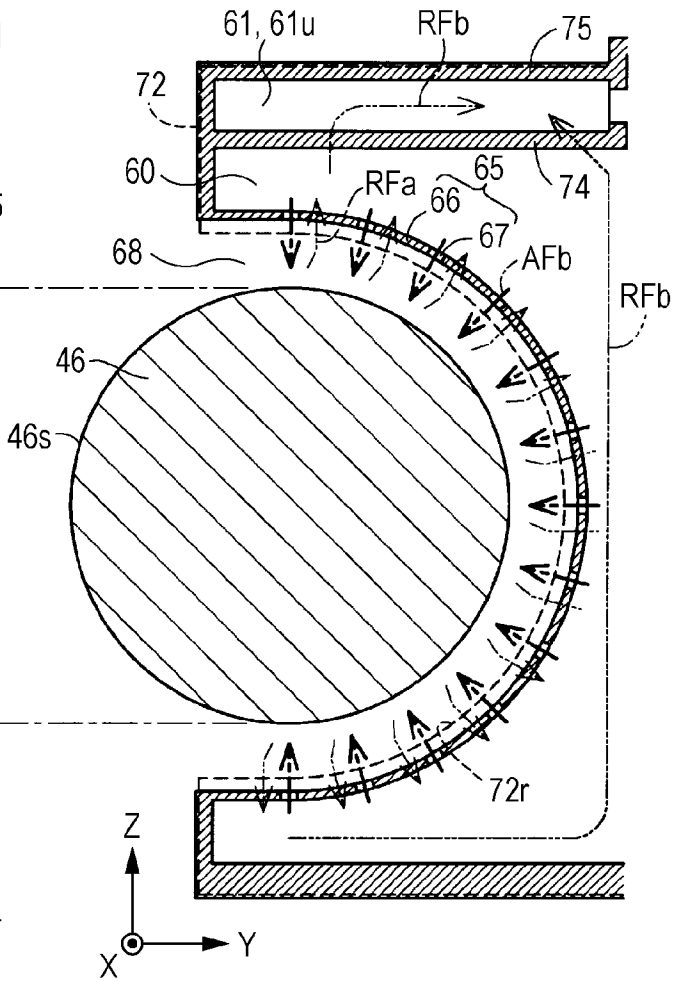
FIGS. 5A and 5B are each a schematic diagram for explaining a function of an air receiver.
Figure 5A:
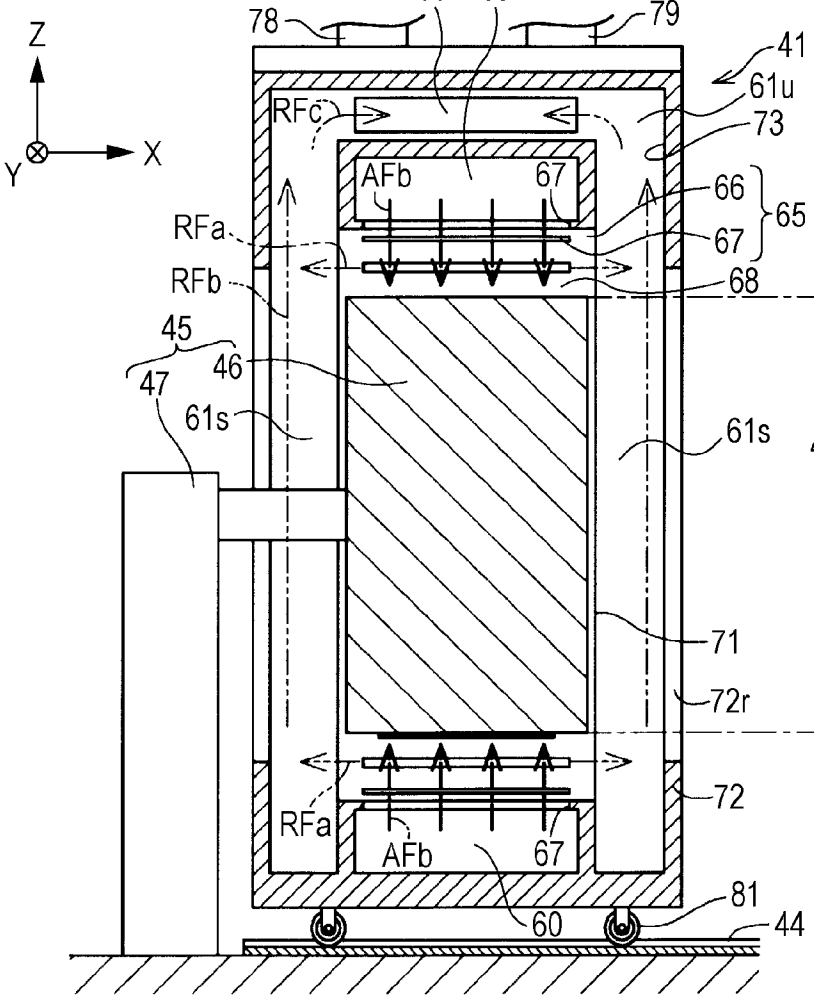

FIGS. 5A and 5B are each a schematic diagram for explaining the function and structure of the air receiver 45. FIGS. 5A and 5B each illustrate a state of the blower unit 41 located at the second position. FIG. 5A illustrates the blower unit 41 and the air receiver 45 as seen in the direction of the arrow Y, and FIG. 5B illustrates the drum disposition region 68 as seen in the opposite direction to the arrow X. In FIGS. 5A and 5B, arrows indicating the flow of air are illustrated similarly to FIG. 2 and FIG. 3.

As described above, when the blower unit 41 is located at the second position, the drum-shaped member 46 of the blower receiver 45 is disposed in the drum disposition region 68 at the same position as the position of the rotational drum 42 with respect to the blower unit 41 at the first position. The drum-shaped member 46 has substantially the same configuration as the rotational drum 42, and has a circumferential lateral surface 46*s* corresponding to the circumferential lateral surface 42*s* of the rotational drum 42. The surface 46*s* is a surface of the blower receiver 45 that receives hot air. Therefore, even when the blower unit 41 is located at the second position, the flow of the air in the blower unit 41 does not practically change from the flow of the air when the blower unit 41 is located at the first position.

In this manner, the dryer 40 in one embodiment includes or accommodates the blower receiver 45. Thus the flow of circulating air in the blower unit 41 is also maintained at the second position in the same manner as the flow of circulating air in the blower unit 41 when at the first position. Therefore, a change in the state of heating by the blower unit 41 due to being away from the rotational drum 42 is reduced, and the blower unit 41 smoothly resumes when print processing is resumed. Also, when the blower unit 41 is located at the second position, reduction in the collection efficiency of hot air in the blower unit 41 is suppressed. Thus an unexpected temperature rise in the printing apparatus 10 due to the heat emitted from the blower unit 41 is suppressed. Therefore, deterioration of the printing apparatus 10 due to heat is reduced.

Summary of First Embodiment

As described above, in one embodiment of the printing apparatus 10, the efficiency of heating by hot air of or provided by the blower unit 41 of the dryer 40 and the efficiency of collecting the hot air are increased. The efficiency of dry processing or of drying the print base material 11 is increased. Also, in the printing apparatus 10, when dry processing in the dryer 40 is suspended, the blower unit 41 maintains the state of heating at the second position away from the print base material 11 supported by the rotational drum 42, and thus the dry processing can be started quickly. Also, while print processing is suspended, deterioration of the print base material 11 supported by the rotational drum 42 due to exposure to heat is reduced.

B. Second Embodiment

Figure 6:
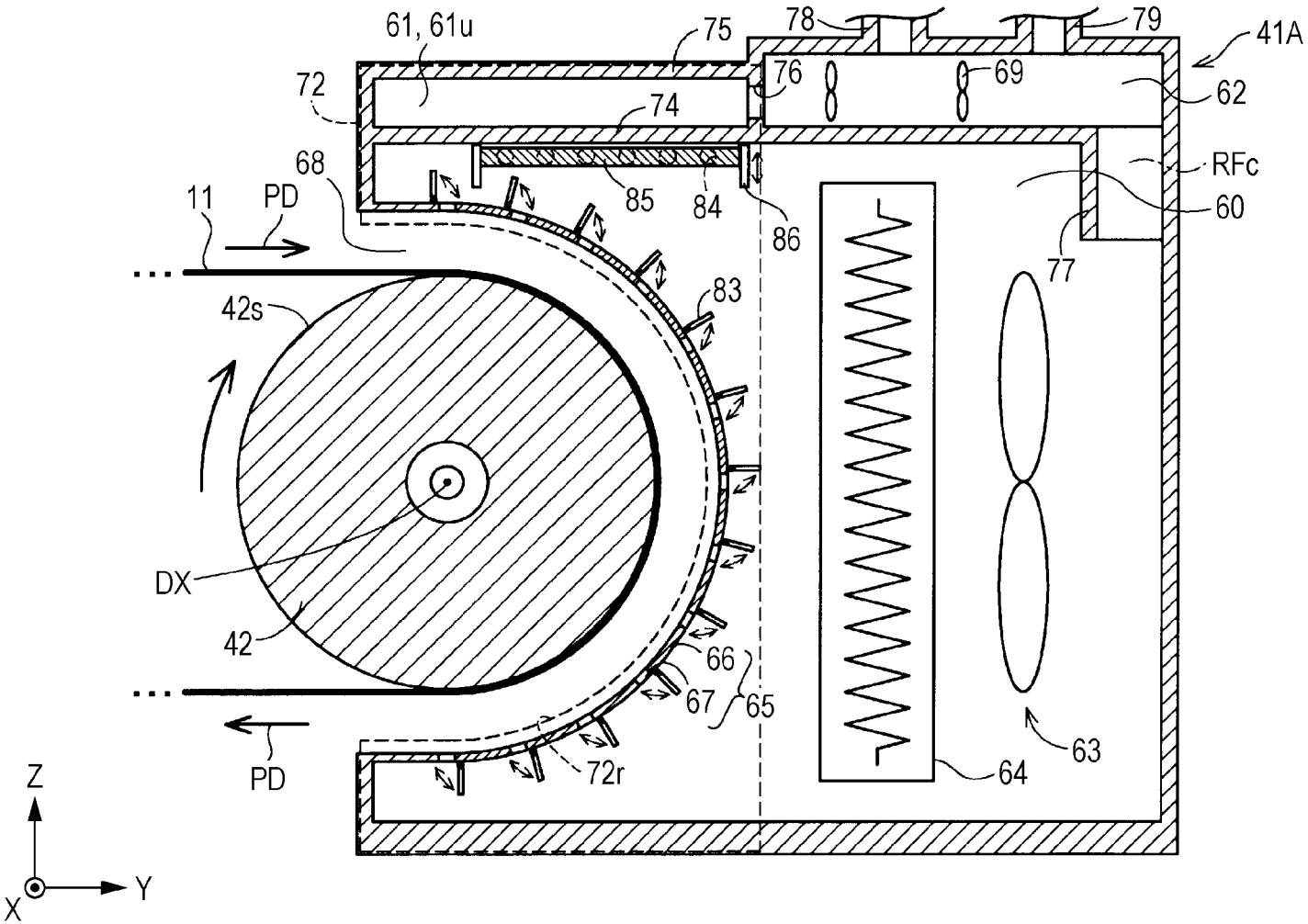
FIG. 6 is a schematic front view illustrating the configuration of a dryer of a printing apparatus according to one embodiment.

FIG. 6 is a schematic front view of a dryer 40A of a printing apparatus as a second embodiment of the invention, as seen in the direction of arrow Y. In FIG. 6, a schematic cross-sectional configuration of the blower unit 41A is illustrated similarly to FIG. 2 which is referenced in the description of the first embodiment. The configuration of the printing apparatus in the second embodiment is substantially the same as the printing apparatus 10 (FIG. 1) in the first embodiment except that the configuration of the dryer 40A is different. The configuration of the dryer 40A and the blower unit 41A in the second embodiment is substantially the same as the configuration in the first embodiment except for the following points. Also, the switching control of the operational state of the blower unit 41A by the controller 12 in the second embodiment is substantially the same as in the description of the first embodiment (FIG. 4). In other words, the controller 12 can switch the blower unit 41A between a first state and a second state.

The dryer 40A in the second embodiment includes no movement unit for displacing the blower unit 41A. In the dryer 40A, the blower unit 41A is disposed at a position corresponding to the first position described in the first embodiment, that is, at the position at which the rotational drum 42 is housed in the drum disposition region 68. In the dryer 40A the blower unit 41A has the following configuration, thereby making it possible to change the operational state without stopping the operation of the blower unit 41A.

In the heating blower chamber 60, the blower unit 41A includes nozzle opening and closing plates 83, bypass communication holes 84, a communication hole opening and closing plate 85, and a side rail 86. The nozzle opening and closing plates 83 are each attached to the front partition 66 via a hinge at a position corresponding to one of the slits 67 of the nozzles 65. The nozzle opening and closing plates 83 can each be rotated by a solenoid mechanism, and each open and close a corresponding slit 67. The solenoid mechanism (not illustrated) may be driven under the control of the controller 12.

The bypass communication holes 84 are each provided as a through hole of or in the side wall 71 of the heating blower chamber 60 and allow the heating blower chamber 60 and the side spaces 61*s* of the exhaust collection chamber 61 to communicate with each other. The communication hole opening and closing plate 85 is held at the side rail 86 so as to allow slide movement while in surface contact with the side wall 71. The communication hole opening and closing plate 85 is moved by the driving force of a motor. The communication hole opening and closing plate opens and closes the bypass communication holes 84. The motor (not illustrated) may be driven under the control of the controller 12.

The controller 12, when performing dry processing of the print base material 11, sets each slit 67 in an open state and the bypass communication holes 84 in a closed state. In other words, the nozzles are open and the bypass communication holes 84 are closed when the print image is being dried. Thus, the blower unit 41 can deliver hot air to the printing surface of the print base material 11 supported by the rotational drum 42 by the same flow of air as described in the first embodiment.

Figure 7:
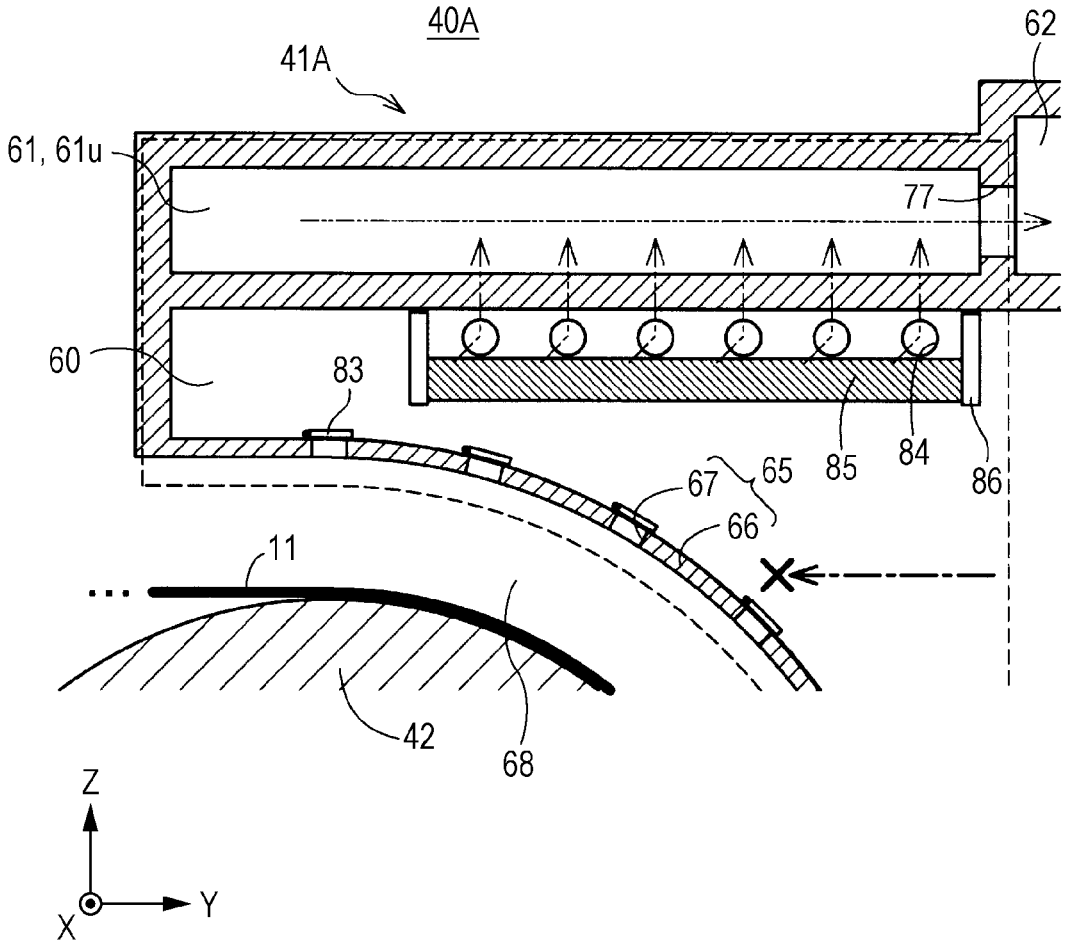
FIG. 7 is a schematic diagram for explaining switching of an operational state in a blower unit.

FIG. 7 is a schematic diagram for explaining switching of the operational state in the blower unit 41A. FIG. 7 illustrates how the operational state of the blower unit 41A is switched. FIG. 7 illustrates a vicinity region of the nozzles 65 and the bypass communication holes 84 in the blower unit 41A as seen in the opposite direction to the arrow X. Also, in FIG. 7, arrows indicating the flow of air in the blower unit 41A are illustrated.

When print processing is suspended and transport of the print base material 11 is stopped, the controller 12 rotates the nozzle opening and closing plates 83 without stopping the operation of the blower unit 41A and sets each slit 67 of the nozzles 65 in a closed state. Thus, the nozzles 65 are closed by rotating the nozzle opening and closing plates 83 to positions illustrated in FIG. 7. In addition, the controller 12 moves the communication hole opening and closing plate 85 to set each of the bypass communication holes 84 in an open state. Thus, the bypass communication holes 84 are opened at the same time. Consequently, a heated air current generated in the heating blower chamber 60 is blocked from flowing out through the slits 67 and instead flows into the exhaust collection chamber 61 through the bypass communication holes 84. In other words, with the heating to the print base material 11 supported by the rotational drum 42 being blocked, the operational state is switched to a state where the hot air is circulated internally. In other words, the air flow circulates inside the blower unit 41A when the nozzles 65 are closes and the bypass communication holes 84 are open.

In the second embodiment, the operational state of the blower unit 41A, in which each slit 67 is opened and each bypass communication hole 84 is closed is interpretable as the first state in which heating to the print base material 11 is allowed. Also, the state in which each slit 67 is closed and each bypass communication hole 84 is opened is interpretable as the second state in which heating to the print base material 11 is blocked. Thus, heated air is delivered to the print base material in the first state and heated air is not delivered to the print base material in the second state. In the second embodiment, at least the opening and closing portions of the slits 67 by the nozzle opening and closing plates 83 correspond to an example of the state switcher that switches the operational state of the blower unit 41A between the first state and the second state.

When print processing is resumed, the controller 12 rotates the nozzle opening and closing plates 83 to open each slit 67, moves the communication hole opening and closing plate 85 to close each bypass communication hole 84, and resumes heat treatment on the print base material 11 supported by the rotational drum 42. In this manner, the blower unit 41A continues to operate until the print processing is resumed. Thus when the print processing is resumed, heat treatment can be quickly resumed. Also, the blower unit 41A does not move like the blower unit 41 in the first embodiment and heat treatment can be resumed more quickly.

In the dryer 40A in the second embodiment, similarly to the first embodiment, while the print processing is suspended, exposure the print base material 11 to the heating by the blower unit 41A is suppressed, and thus deterioration of the print base material 11 is reduced. In order to more reliably block the heating of the print base material 11 while the print processing is stopped, the nozzle opening and closing plates 83 and the front partition 66 may be composed of a highly heat insulating material. Alternatively, the inside and/or the surfaces of the nozzle opening and closing plates 83 and the front partition 66 are provided with a heat insulating layer.

As described above, with the printing apparatus in the second embodiment, when transport of the print base material 11 is stopped, heat treatment to the print base material 11 can be stopped by changing the flow of the hot air, and thus the operation of the dryer 40A can be set in standby without being stopped. Therefore, heat treatment provided by the dryer 40A can be efficiently resumed. Also, the space for moving the blower unit 41A (the space for moving the blower unit 41) may not be provided in the printing apparatus in the second embodiment, and thus the printing apparatus can have a smaller size than the printing apparatus in the first embodiment. In addition, with the printing apparatus in the second embodiment, it is possible to achieve the operational effects similar to those of the printing apparatus in the first embodiment.

C. Modification

C1. First Modification

In the printing apparatus in the above-described embodiments, continuous printing is performed on the strip-shaped print base material 11. However, in the printing apparatus in the above-described embodiments, print processing may be performed on a single print sheet as a recording medium having a predetermined size other than the size of the strip-shaped print base material 11. The print medium may not be continuous in one example.

C2. Second Modification

The printing apparatus in the above-described embodiments is configured as an ink jet line printer. However, the printing apparatus in the above-described embodiments may not be configured as a line printer and may be configured as a serial printer that forms a print image by moving a print head for ejecting ink droplets back and forth. Also, the printing apparatus in the above-described embodiments is not limited to an ink jet printer and may be configured as a printer that forms a print image by exposing printing paper, for instance. In this case, the dryers 40, 40A may dry developing solution adhering to the printing paper or medium. Different types of liquids may be ejected from the print heads and the type of print medium may be selected according to the type of liquid being ejected.

C3. Third Modification

The dryers 40, 40A in the above-described embodiments heat the print base material which is supported and transported by the rotational drum 42. However, the dryers 40, 40A may include a supporter for the recording medium other than the rotational drum 42 and may heat a fixedly supported recording medium without being transported.

C4. Fourth Modification

The dryers 40, 40A in the above-described embodiments heat the print base material 11 by hot air (e.g., a hot air flow) which is a heated air current generated by the blower fan 63. However, the dryers 40, 40A may heat the print base material 11 with heat from the heat source 64 without using hot air.

C5. Fifth Modification

In the first embodiment, the dryer 40 includes the blower receiver 45 at the second position. However, the dryer 40 may not include the blower receiver 45 at the second position. Alternatively, the dryer 40 may have a blower receiver that receives the hot air from the blower unit 41 at the second position. However, the blower receiver may be a member that has a shape that is different from the rotational drum 42 (for instance, a plate-like shape).

C6. Sixth Modification

The blower units 41, 41A in the above-described embodiments include the exhaust collection chamber 61 and the circulation air regulation chamber 62, which collect and circulate the hot air delivered through the nozzles 65. However, the blower units 41, 41A may not include the exhaust collection chamber 61 or the circulation air regulation chamber 62, and may not collect and circulate the hot air delivered through the nozzles 65. Alternatively, the blower units 41, 41A may discharge all the collected hot air to the outside without returning the hot air to the heating blower chamber 60.

C7. Seventh Modification

The blower units 41, 41A in the above-described embodiments have the drum disposition region 68 which is recess space surrounded by the slits 67 of the nozzles 65. However, the blower units 41, 41A in the above-described embodiments may not have the drum disposition region 68 which is formed as recess space. The blower units 41, 41A may have nozzles in which slits are arranged in the front partition in a plate-like shape.

C8. Eighth Modification

In the above-described embodiments, the controller 12 sets the operational state of the blower units 41, 41A to the first state during execution of print processing or while processing a printed image. The controller 12 switches the blower units 41, 41A to the second state when the print processing is temporarily suspended. However, the controller 12 may perform switching of the operational state of the blower units 41, 41A at a timing other than when the print processing is temporarily suspended. For instance, the controller 12 may set the operational state of the blower units 41, 41A to the first state during execution of print processing, and may switch the blower units 41, 41A to the second state during the interval from completion of the print processing until the subsequent print processing is started. Alternatively, the controller 12 may set the blower units 41, 41A to the second state at the time of activation of the blower units 41, 41A and may switch to the first state when the operation temperature of the blower units 41, 41A exceeds a predetermined temperature. In the above-described embodiments, the controller 12 switches the operational state of the blower units 41, 41A to the second state after the dry processing of an undried print image is completed in the dryers 40, 40A. However, the controller 12 may immediately switch the operational state of the blower units 41, 41A to the second state when receiving a command to stop transport of the print base material 11 without detecting an undried print image and without drying the undried print image in one example.

C9. Ninth Modification

In the printing apparatus in the above-described embodiments, the operational state of the blower units 41, 41A in the dryers 40, 40A is switched under the control of the controller 12. However, in the printing apparatus in each embodiment, the operational state of the blower units 41, 41A in the dryers 40, 40A may not be switched by the control of the controller 12. The operational state of the blower units 41, 41A may be switched with a direct operation or command from a user or the operational state may be automatically switched from the first state to the second state in synchronization with stop of transport of the print base material 11.

C10. Tenth Modification

In the first embodiment, the blower unit 41 includes the rail 44 and the pulley 81 as an example of the movement units. However, the blower unit 41 may include a movement unit other than the rail 44 and the pulley 81. The blower unit 41 may include a movement unit that moves the blower unit with a shaft which is expandable and contractable, for instance, by a hydraulic pressure or the like. Also, in the first embodiment, the blowing unit 41 moves in the direction parallel to the arrow X of the rotation drum 42. However, the blowing unit 41 may move in a direction crossing the rotation axis DX, such as in the direction of the arrow Y or in the direction of the arrow Z. In the above-described embodiments, the blower unit 41 moves with linear movement in one direction between the first position and the second position. However, the blower unit 41 may move in a plurality of directions while changing the moving direction or may move in a curve between the first position and the second position.

C11. Eleventh Modification

In the second embodiment, the blower unit 41A includes the nozzle opening and closing plates 83, which rotate by a hinge mechanism, as the opening and closing portions of the slits 67. However, the blower unit 41A may include a nozzle opening and closing plate which slidably moves like the communication hole opening and closing plate 85, as the opening and closing portions of the slits 67 or may include opening and closing portions of the slits 67 in another configuration. In the blower unit 41A in the second embodiment, the bypass communication holes 84 and the communication hole opening and closing plate 85 may not be provided.

C12. Twelfth Modification

In the above-described embodiments, the printing unit 30 includes the rotational drum 31 and uses the rotational drum 31 as a platen to eject ink droplets from the print heads 33 to the print base material 11. However, the printing unit 30 may not include the rotational drum 31, and may eject ink droplets from the print heads 33 to the print base material 11 which, for instance, extends horizontally and is transported on a flat platen.

The invention is not limited to the above-described embodiments, examples, and modifications, and may be implemented in various configurations in a range not departing from the spirit of the invention. For instance, the technical features in the embodiments, examples, and modifications corresponding to the technical features in each aspect described herein may be replaced or combined as needed in order to solve part or all of the above-mentioned problems or to achieve part or all of the above-mentioned effects. In addition, if a technical feature is not described as required in the present description, the technical feature may be deleted as needed.

What is claimed is:

1. A printing apparatus comprising:

a print head that forms a print image on a recording medium;

a first supporter that supports the recording medium which is in a position facing the print head;

a second supporter located downstream of the first supporter that supports the recording medium on which the print image is formed;

a heater that selectively heats the recording medium supported by the second supporter; and a state switcher that switches the heater between a first state in which heat is delivered to the recording medium and a second state in which heat is not delivered to the recording medium in a state where the heater is in operation, wherein the state switcher includes a movement unit that moves the heater to a first position when the heater is in the first state or moves the heater to a second position when the heater is in the second state, the second position being more distant from the recording medium than the first position.

2. The printing apparatus according to claim 1, wherein the heater includes a blower that delivers hot air, and the state switcher includes a hot air receiver that receives the hot air from the blower when the heater is located at the second position.

3. The printing apparatus according to claim 2, wherein the heater further includes a collector that collects at least part of the hot air which is delivered from the blower.

4. The printing apparatus according to claim 3, wherein the hot air receiver has a surface corresponding to a surface of the second supporter that receives the hot air from the blower when the heater in located at the first position.

5. The printing apparatus according to claim 1, wherein heating of the recording medium is blocked when the heater is in the second state and wherein heating of the recording medium is allowed when the heater is in the first state.

6. The printing apparatus of claim 1, wherein the second supporter is disposed in a recess space of the heater.

7. The printing apparatus of claim 6, wherein the heater includes a partition wall that is arranged to follow a surface of the second supporter, wherein slits are arranged in the partition wall in a width direction and wherein the heat is delivered by blowing hot air through the slits.

8. A printing apparatus comprising:

a print head that forms a print image on a recording medium;

a first supporter that supports the recording medium which is in a position facing the print head:

a second supporter located downstream of the first supporter that supports the recording medium on which the print image is formed;

a heater that selectively heats the recording medium supported by the second supporter; and a state switcher that switches the heater between a first state in which heat is delivered to the recording medium and a second state in which heat is not delivered to the recording medium in a state where the heater is in operation, wherein the heater includes a blower that delivers hot air through an air blowing opening to heat the recording medium, and the state switcher includes an opening and closing portion that opens the air blowing opening in the first state and closes the air blowing opening in the second state.

9. A printing apparatus comprising:

a print head that forms a print image on a recording medium;

a first supporter that supports the recording medium which is in a position facing the print head:

a second supporter located downstream of the first supporter that supports the recording medium on which the print image is formed;

a heater that selectively heats the recording medium supported by the second supporter; and a state switcher that switches the heater between a first state in which heat is delivered to the recording medium and a second state in which heat is not delivered to the recording medium in a state where the heater is in operation, a controller that controls the state switcher, wherein the second supporter is configured to transport the recording medium so that the recording medium passes through a heating region heated by the heater when the heater is in the first state, and when transport of the recording medium by the second supporter is stopped, the controller switches the heater from the first state to the second state with the state switcher.

10. The printing apparatus according to claim 9, wherein the controller controls the transport of the recording medium by the second supporter, and when the transport of the recording medium by the second supporter is stopped, the controller stops the transport by the second supporter after the print image formed on the recording medium by the print head passes through the heating region, and the controller switches the heater from the first state to the second state with the state switcher.

* * * * *